US008714529B2

(12) United States Patent
Smith

(10) Patent No.: US 8,714,529 B2
(45) Date of Patent: May 6, 2014

(54) VARIABLE RAIL RECEIVING UNIT

(75) Inventor: Gary Smith, Jarrow (GB)

(73) Assignee: Preforma Limited, Newcastle Upon Tyne (GB)

( * ) Notice: Subject to any disclaimer, the term of this patent is extended or adjusted under 35 U.S.C. 154(b) by 0 days.

(21) Appl. No.: 13/395,522

(22) PCT Filed: Sep. 15, 2010 (Under 37 CFR 1.47)

(86) PCT No.: PCT/GB2010/051546

§ 371 (c)(1), (2), (4) Date: Oct. 4, 2012

(87) PCT Pub. No.: WO2011/033297

PCT Pub. Date: Mar. 24, 2011

(65) Prior Publication Data

US 2013/0075681 A1 Mar. 28, 2013

(30) Foreign Application Priority Data

Sep. 17, 2009 (GB) ..... 0916327.0

(51) Int. Cl.
*E04H 17/14* (2006.01)

(52) U.S. Cl.
USPC ..... 256/67

(58) Field of Classification Search
USPC ..... 256/60, 65.01–65.05, 65.08, 65.11, 256/65.12, 67; 403/53, 54, 57, 113, 114
See application file for complete search history.

(56) References Cited

U.S. PATENT DOCUMENTS

| | | | | |
|---|---|---|---|---|
| 1,423,927 | A | 7/1922 | Falk | |
| 3,489,392 | A | 1/1970 | Thom | |
| 3,741,595 | A | 6/1973 | Horgan, Jr. | |
| 4,053,140 | A * | 10/1977 | Clemens et al. | 256/19 |
| 4,928,930 | A | 5/1990 | Chung | |
| 6,149,337 | A * | 11/2000 | Newton et al. | 403/122 |
| 6,279,880 | B1 | 8/2001 | Hawks, Jr. | |
| D468,835 | S | 1/2003 | Schiefelbein et al. | |
| 7,913,983 | B1 * | 3/2011 | Sandor, Sr. | 256/67 |
| 2007/0246698 | A1 | 10/2007 | Truckner et al. | |
| 2008/0173857 | A1 | 7/2008 | Edwards | |

FOREIGN PATENT DOCUMENTS

| | | | |
|---|---|---|---|
| DE | 29803954 | U1 | 10/1998 |
| DE | 19945564 | A1 | 3/2001 |
| DE | 20314535 | U1 | 12/2003 |
| DE | 202004019403 | U1 | 4/2006 |
| EP | 1026339 | A2 | 8/2000 |
| EP | 1387019 | A2 | 2/2004 |
| GB | 563093 | A | 7/1944 |
| GB | 972491 | A | 10/1964 |
| GB | 2443193 | A | 4/2008 |
| WO | WO-2004/088054 | A1 | 10/2004 |

OTHER PUBLICATIONS

Severens, Gert, "International Search Report" for PCT/GB2010/051546, as mailed Jul. 6, 2011, 5 pages.

* cited by examiner

*Primary Examiner* — Michael P Ferguson
*Assistant Examiner* — Daniel Wiley
(74) *Attorney, Agent, or Firm* — Winstead PC

(57) ABSTRACT

A rail receiving unit is disclosed that includes an inner housing within an outer housing. The inner housing is adapted to receive a rail and to be pivotable about an axis in relation to the outer housing such that the angle at which the rail is received into the receiving unit is variable. A preferred embodiment allows the inner housing to be both pivotable and rotatable in relation to the outer housing.

9 Claims, 6 Drawing Sheets

VARIABLE RAIL RECEIVING UNIT

BACKGROUND

1. Field of the Invention

The present invention relates to a handrail assembly, as well as the rail receiving unit and balusters which make up part of the assembly, which allows easy assembly of a handrail on both flat/horizontal and inclined surfaces. In particular the invention allows for a handrail to be assembled without the need for a skilled craftsman to determine angles, such that upper and lower rails remain at an even or predetermined distance from the ground even when the rail is positioned on an inclined surface such as a ramp or stairs.

2. History of the Related Art

Traditionally, when a handrail is being assembled it is necessary for a skilled craftsman to position a number of balusters, generally equidistant from each other, and to weld upper and lower rails between the balusters to provide the handrail. When the handrail is required to go down an incline, such as for use on a ramp or stairs, it is necessary to carefully determine the angle of the incline and to cut the ends of the upper and lower rail sections in order that they are angled appropriately and have the appropriate profiles to allow them to be positioned between the relevant balusters and welded at the predetermined angle. This is time consuming and prone to errors which often results in the upper, and particularly the lower rail sections being misaligned.

There have been handrail assembly systems developed which attempt to simplify the handrail assembly process. However many of these require the handrail to be pre-formed and then transported to the site. Whilst this reduces the skill required onsite, problems can arise when the information that is used to manufacture the pre-formed handrail offsite is incorrect (for example if the details regarding angles of incline are inaccurate the handrail will not assemble correctly onsite). It is only when the premade handrail arrives onsite at the place which it is to be used that any errors are found and it requires either a new rail to be produced, or corrections to be made onsite.

SUMMARY

The present invention aims to obviate or mitigate one or more of the problems associated with the prior art.

Throughout this document the terms tubing or tube can be taken to be a tube of any appropriate cross-section and which may be hollow or solid. Furthermore, the terms railing or rail can be taken to be a rail of any appropriate cross-section (which may itself be a tube).

According to a first aspect of the present invention, there is provided a rail receiving unit, comprising;

an outer housing; and an inner housing within the outer housing, the inner housing being adapted to receive a rail, said inner housing being pivotable about an axis and in relation to the outer housing such that the angle at which the rail is received into the receiving unit is variable.

By providing a unit which can receive a rail at variable angles (i.e. the angle at which the rail is received can be varied) it is very easy to assemble a handrail on any sloping ground without the need to cut and weld rails.

Preferably the outer housing is attachable to one or more sections of tubing.

The tubing may be a baluster.

Preferably the outer housing is an annular member with a circular inner circumference.

By providing the outer housing with means for attaching to a section of tubing such as a baluster a handrail can be provided in kit form and easily assembled on site, allowing for different sized balusters to be provided with rails at varying heights, and easily accommodating the assembly of handrails on various slopes.

Most preferably, securing projections are provided between the inner surface of the outer housing the outer surface of the inner housing, said securing projections pivotally connecting the outer housing to the inner housing and defining an axis about which the inner housing can pivot.

Advantageously, having an inner housing pivotally connected to an outer housing by securing projections, the outer surface of the handrail remains smooth and it is difficult to tamper with the connection between the outer and inner housing. This ensures that the product can be used in both commercial and in non-commercial settings.

The securing projections may be formed integrally with the inner housing.

The outer surface of the inner housing may be formed, using injection moulding or other methods, with the securing projections extending outwards, which in use will be towards the outer housing.

The outer housing will then interface with the securing pin.

Preferably the outer housing is provided with a channel extending at least partially around its inner circumference.

In the preferred embodiment the securing projections interlock with the channel.

Most preferably the securing projections are received within the channel.

Advantageously, arranging the securing projections so that they are received within the channel allows the inner housing to rotate within the outer housing around the channel's circumference whilst also being able to pivot about axis formed by the securing projections.

An alternative is that the securing projections are formed integrally with the outer housing.

The inner housing will then interface with the securing pin.

The channel will then extend at least partially around the outer circumference of the inner housing.

The inner housing may be in the form of a sphere or ball with a sleeve channel running therethrough.

The sleeve channel may be open-ended or closed-ended.

An open ended channel will allow the rail to pass all of the way through the inner housing, which is useful for balusters in the mid section of a handrail, whereas a closed ended channel will receive the rail but will not allow it to pass through the inner housing completely, which is useful for an end section of a handrail.

The sleeve channel may be provided with one or more rubber seals.

Said rubber seals may sit within grooves formed in the wall of the channel in the inner housing.

The rubber seals allow a close fit with the rail that is to be received in the inner housing.

In the preferred embodiment, the outer housing is provided with one or more attachment sections which are securable to portions of a baluster.

The outer housing can be attached to the baluster by one attachment means at the top of the baluster or can be attached at two points (above and below) midway down the baluster.

Preferably the outer housing is formed in one piece.

An alternative option is that the outer housing comprises two arcuate sections that are held together at the top and bottom.

Most preferably the two sections are held together by securing pins.

In the preferred embodiment, the attachment sections comprise a protruding tubular section surrounded by a rubber sleeve.

The outer circumference of the rubber sleeve is selected to securely fit into a baluster section. This allows the rail receiving unit to easily push-fit onto the baluster leaving the outer surface of the baluster smooth and free from screws or welded sections.

Optionally the outer and inner housing are formed from WCB carbon steel.

An alternative option the outer and inner housing are formed from Stainless steel or Aluminium.

According to a further aspect of the present invention there is provided a baluster comprising one or more rail receiving units according to the previous aspects.

A yet further aspect of the present invention relates to a handrail assembly comprising a plurality of rail receiving units according to the previous aspects, a plurality of baluster sections and a plurality of rails.

Preferably the rail assembly also comprises a plurality of base plates which are adapted to receive baluster sections, such that the balusters are secured to the ground and protrude substantially vertically.

Throughout the description and claims of this specification, the words "comprise" and "contain" and variations of the words, for example "comprising" and "comprises", means "including but not limited to", and is not intended to (and does not) exclude other components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

In order to provide a better understanding of the present invention, embodiments will now be described, by way of example only, and with reference to the following drawings in which,

DETAILED DESCRIPTION

Figure 1:
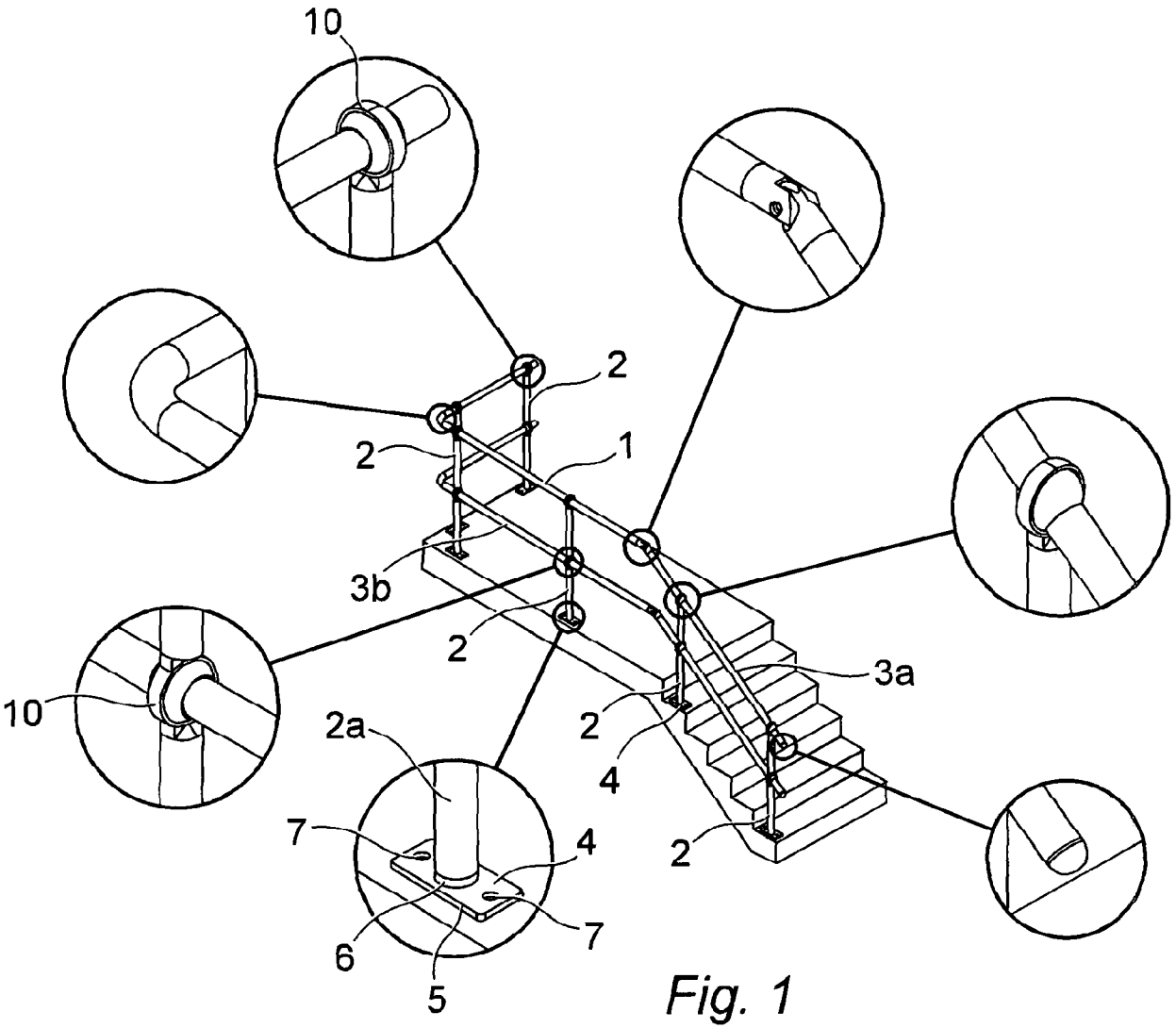
FIG. 1 is a view of a handrail that has been assembled using the present invention.

While the invention is susceptible to various modifications and alternative forms, specific embodiments thereof are shown by way of example in the drawings and will herein be described in detail. It should be understood that the drawings and detailed description thereof are not intended to limit the invention to the particular form disclosed, but on the contrary, the intention is to cover all modifications, equivalents and alternatives falling within the scope of the invention as defined by the appended claims.

Further, although the invention will be described in terms of specific embodiments, it will be understood that, where technically feasible, the elements of the specific embodiments of the invention will be applicable to all embodiments disclosed herein.

A handrail 1, generally depicted in FIG. 1, typically comprises a number of substantially vertically extending balusters 2 that are spaced apart from each other and act as supporting posts for horizontal rails (shown in FIG. 1). In the preferred handrail 1 configuration that is shown in FIG. 1 there is provided an upper rail 3*a* and a middle rail 3*b*. The balusters are secured to the ground by base plates 4.

Each base plate 4 comprises a solid planar base 5 with a cylindrical section 6 protruding therefrom. In the preferred embodiment the cylindrical section 6 protrudes substantially perpendicular to the solid planar base 5. The solid planar base 5 has a number of apertures 7 adapted to receive screws such that the based plate 4 can be securely screwed to the ground. In alternative embodiments where the base plate 4 is for attachment to an inclined surface, such as a ramp, (not shown) the cylindrical section 6 may not extend perpendicular to the planar base 5 but instead extend from the planar base 5 at an angle which ensures it is protruding substantially vertically when the base plate 4 is securely screwed into the ground.

Figure 7:
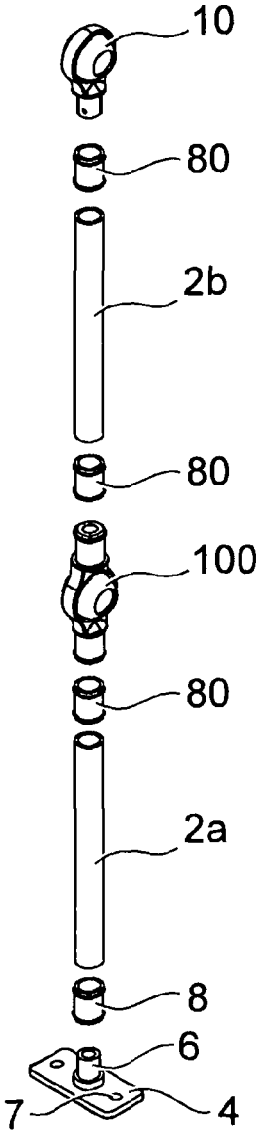
FIG. 7 is an exploded view of the baluster also shown in FIG. 6.
Figure 8A:
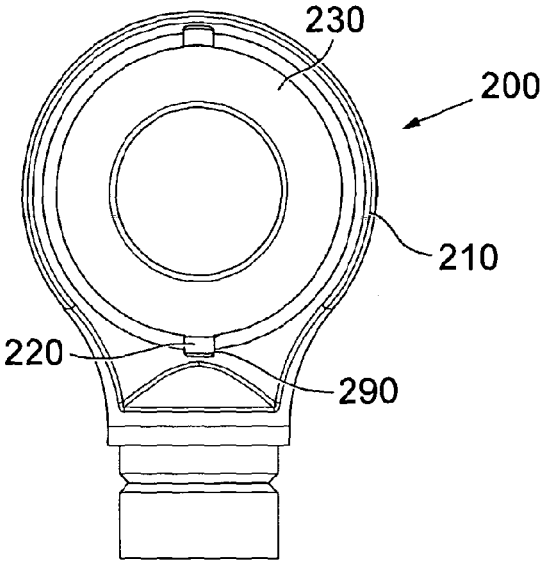
FIGS. 8*a-d* show a front view, side view, top view and isometric view of a first variant of preferred second embodiment of a rail receiving unit, this embodiment being particularly suited to receiving the upper rail of a handrail.
Figure 8B:
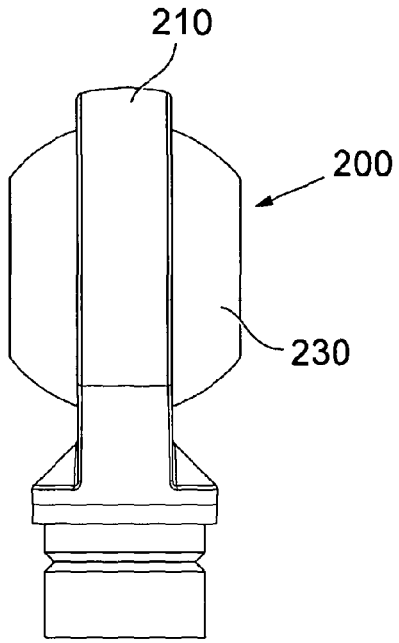
Figure 8C:
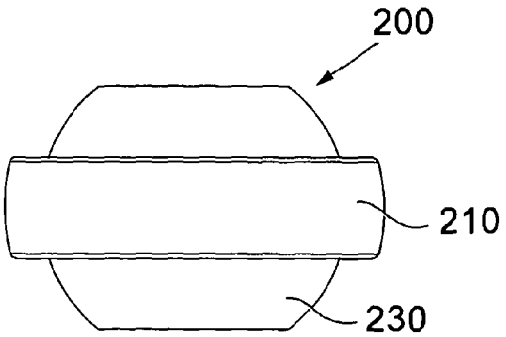
Figure 8D:
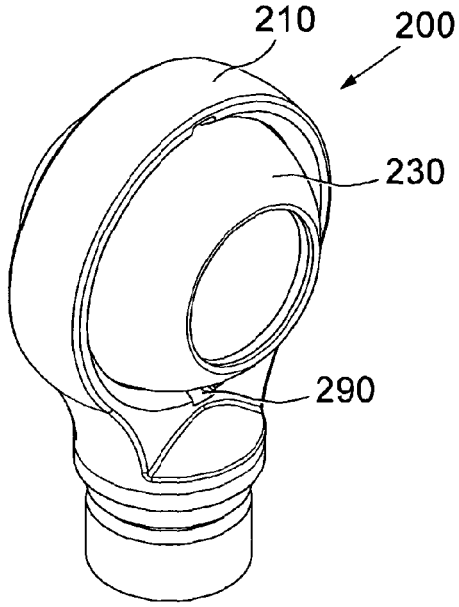
Figure 9A:
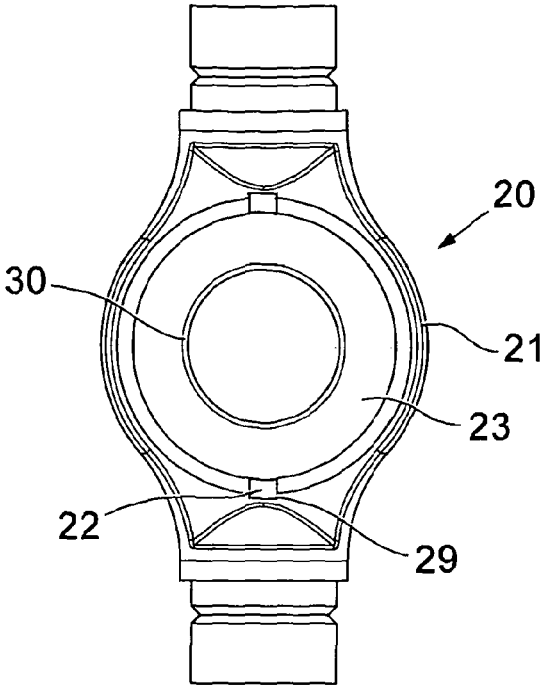
FIGS. 9*a-d* show a front view, side view, top view and isometric view of a first variant of preferred second embodiment of a rail receiving unit, this embodiment being particularly suited to receiving the middle rail of a handrail.
Figure 9B:
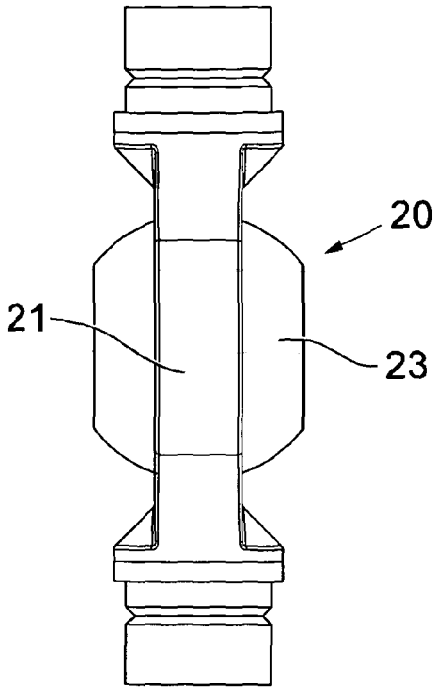
Figure 9C:
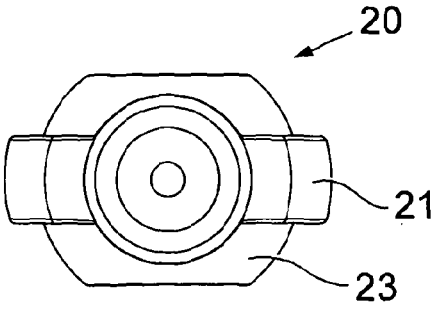
Figure 9D:
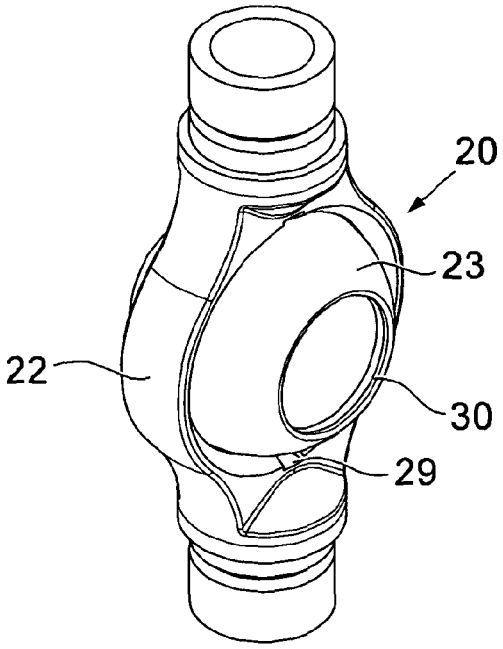

Once the base plate 4 is secured to the ground, the lower section 2*a* of a baluster 2 is then attached to the base plate 4 (most clearly seen in FIG. 7). The baluster 2 is itself in the form of a tube, or is provided with a channel at its lower end for receiving the protruding cylindrical section 6 of the base plate 4. In the preferred embodiment, a rubber sleeve 8 is fitted over the protruding cylindrical section and secured in place. The lower end of the baluster 2 is then pushed over the rubber sleeve 8 such that the baluster 2 is then held in an upright position by interference fit. The rubber sleeve 8 is selected so that it is resiliently biased to push outward onto the inner surface of the baluster 2 when the baluster 2 is in position.

To ensure a tight fit between the base plate 4 and the baluster 2, the rubber sleeve 8 is heated prior to the baluster being pushed over it, such that when the rubber cools a tight fit is obtained and it is extremely difficult to the separate the sections. Ideally, the rubber sleeve 8 is also provided with raised ridges (not shown in FIG. 1) extending circumferentially around the outer surface of the rubber sleeve 8. The ridges are generally positioned towards the outer edges of the rubber sleeve 8.

Figure 2:
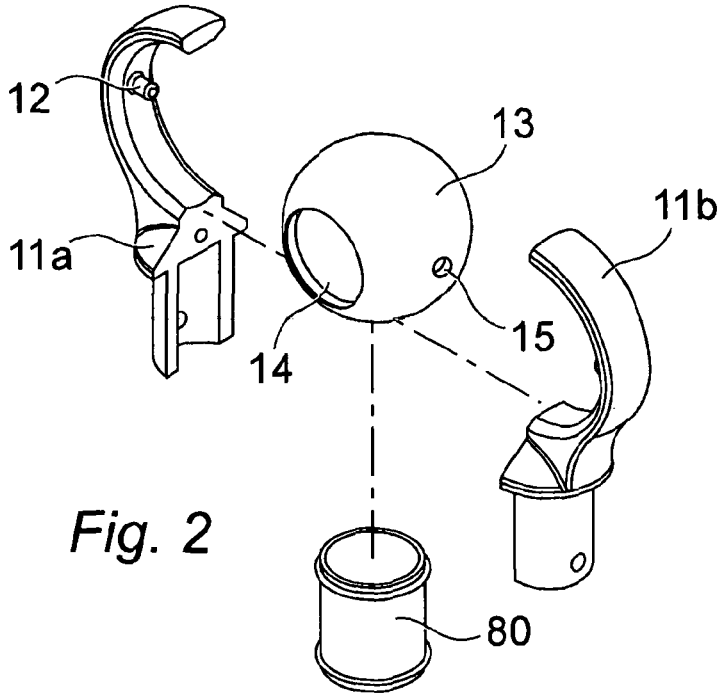
FIG. 2 is an exploded view of one variant of a first embodiment of a rail receiving unit, this embodiment being particularly suited to receiving the upper rail of a handrail.
Figure 3:
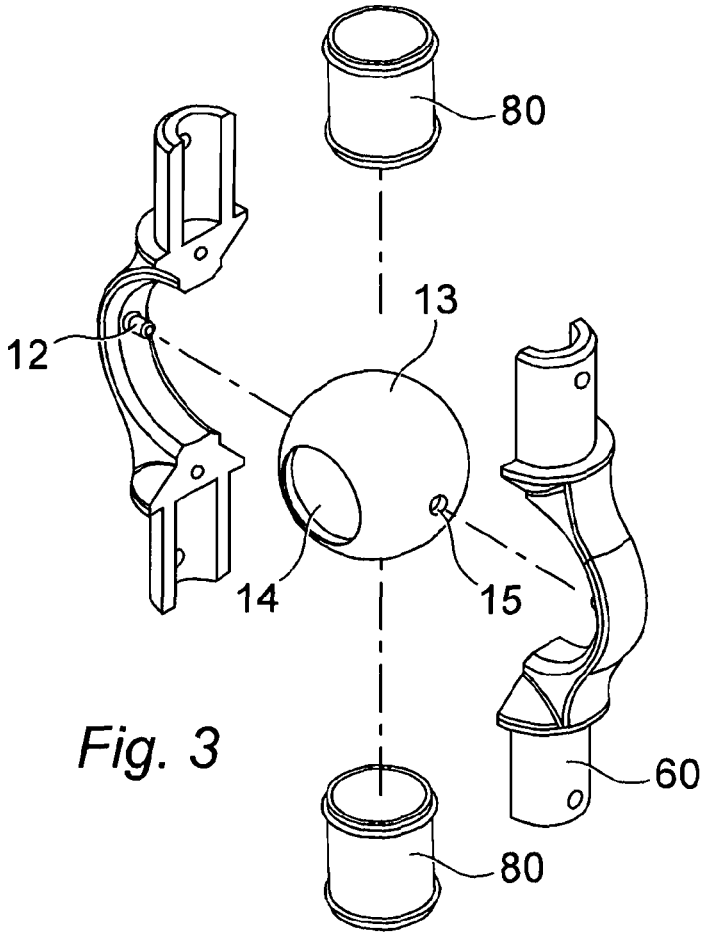
FIG. 3 is an exploded view of another variant of the first embodiment of a rail receiving unit, this embodiment being particularly suited to receiving a middle rail of a handrail.
Figure 4:
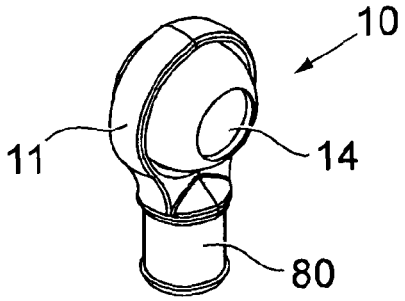
FIG. 4 is an isometric view of the rail receiving unit also shown in FIG. 2.
Figure 5:
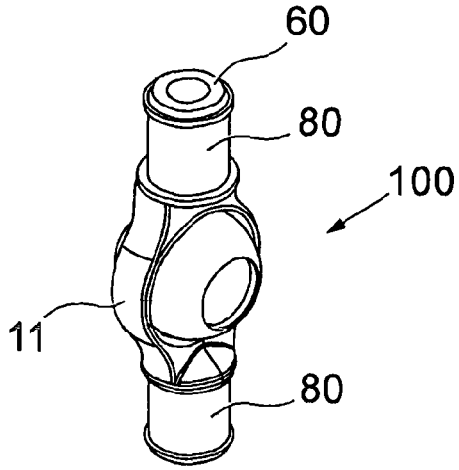
FIG. 5 is an isometric view of the rail receiving unit also shown in FIG. 3.
Figure 6:
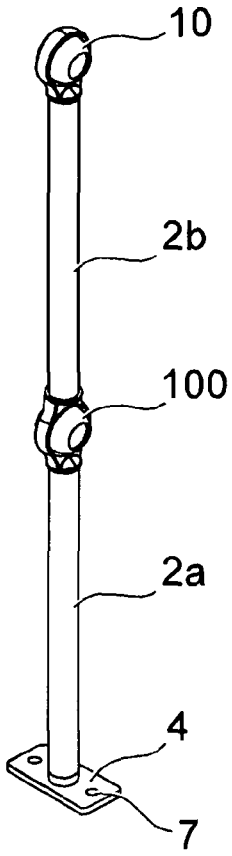
FIG. 6 is an isometric view of the a baluster according to the present invention.

Embodiments of a first basic rail receiving unit 10,100 are depicted in FIGS. 2, 3, 4 and 5. One embodiment is for attachment to the top of a baluster 2 (FIGS. 3 and 5) and the other for attachment to a mid or other lower point along a baluster 2 (FIGS. 2 and 4). In each case the rail receiving unit 10 has an outer housing 11 (shown most clearly in FIGS. 4 and 5) which has been cast from carbon steel in two parts 11*a* and 11*b* which can be secured together to form a complete outer housing. A preferred embodiment of a rail receiving unit 10 for use at the top of a baluster 2, as shown in FIGS. 3 and 5, has the two parts 11*a* and 11*b* as two identical arcuate halves which combine to make a circular whole with a substantially circular central aperture. In addition the lower ends of the arcuate halves extend downwards to for part of a tubular protrusion which, when the two arcuate halves are brought together form a cylindrical protrusion 60 which will extend downwards. The cylindrical protrusion is provided with a channel that spans both halves to form a locating hole and securing pin can be provided in the locating hole to hold the two sections together. As with the base plate 4 discussed above, the cylindrical protrusion 60 is again provided with an outer rubber sleeve 80 (of the same type as already mentioned) which allows the baluster 2 to be push-fit over it. The same heat sealing method can be used to provide a tight fit.

The inner surfaces of the outer housing are provided with two pivot pins 12 that extend out from the inner surface. The pivot 12 pins are positioned such that they oppose each other and thus define an axis between each other. Advantageously as the pins 12 are integral with the outer housing 11, this means that there is a smooth outer surface on the rail receiving unit. The pivot pins are positioned such that when the rail receiving unit 10 is attached to an upright baluster 2, the axis defined by the pins 12 is substantially perpendicular to the axis defined by the length of the baluster 2. The pivot pins 12 are shaped to pivotally receive the inner housing 13 there between in a manner that retains the inner housing 13 in position but allows it to pivot about the axis defined by the pins 12. Usually the inner housing 13 has indentations 15 on its outer surface, which could be in the form of channels, which are positioned to receive the pins 12.

Notably, allow these embodiments shown have the pivot pins 12 integrally formed as part of the inner surface of the outer housing 11, it can be envisaged that the pivot pins could be provided as an integrally formed part of the outer surface of the inner housing. In this case it is likely that the inner surface of the out housing would be provided with an indentation of some kind to receive the pivot pins. Yet further, the pivot pins could be separate pins that sit between the inner and outer housing at predefined points. In this case both the inner and outer housing would be provided with appropriately positioned indentations in which the pins would sit to ensure that the pins would still act to form an axis for the inner housing to pivot about. In all of these cases the pins are tamper proof as they cannot be accessed from the outer surface of the outer section as they do not protrude all of the way through the outer housing.

The inner housing 13 is, in a preferred embodiment, provided as a ball with a aperture channel 14 running through the centre (most clearly shown in FIGS. 2 to 5). The channel 14 is shaped to receive a rail 3*a* or 3*b* (shown only in FIG. 1) and will generally have a circular cross section slightly larger than a standard handrail horizontal rail 3*a* or 3*b*. As mentioned above, the inner housing is of a size that will sit within the central aperture of the outer housing 11 and will be held in place by pivot pins but will be able to pivot about an axis. This allows the angle of the channel 14 into which a rail 3*a* or 3*b* is received to be altered depending on whether the handrail 1 at that point is travelling along a flat surface or whether it will be travelling up an incline. As a rail 3*a* or 3*b* will be passed through at least two rail receiving units 10 on neighbouring balusters 2 to form a handrail 1 it may be that one baluster 2 will be higher or lower than its neighbour such that the rail will not extend at 90 degrees from the length of the baluster 2 but may extend at an angle greater or less than 90 degrees depending on the incline of the ground between said balusters 2. This can be seen most clearly in FIG. 1 where part of the handrail 1 is on a flat surface and part travels down stairs at an incline. On the flat section the rail receiving units 10 have the longitudinal axis of the channels 14 running substantially at 90 degrees to the longitudinal axis of the balusters 2, whereas when the handrail 1 is positioned on the stairs the rail receiving units 10 have the inner housing 13 angled such that the longitudinal axis of the channels 14 is less than 90 degrees to the longitudinal axis of the balusters 2 (taking the angle between the longitudinal axis of the channel 14 and the longitudinal axis of the baluster section 2*a* or 2*b* that is below the relevant rail receiving unit 10).

It is not generally be necessary to fix the rail 3*a* or 3*b* in position or the inner housing 13 at a particular. As the rail 3*a* or 3*b* will be continuous, it will itself dictate the angle that the inner housing 13 is held at. However at the ends of the handrail it is possible to either fix the rail to a wall or other upright support or to provide an end cap which prevents the rail (3*a* or 3*b* passing all of the way through the final inner housing 13.

For a typical baluster used in the assembly of a handrail 1, a dual ended rail receiving unit 10 (as depicted in FIGS. 2 and 4) is inserted into the upper end of the already upright lower baluster section 2*a* and then an upper baluster section 2*b* is placed on the other end thus connecting the lower baluster 2*a* and upper baluster 2*b* with a central rail receiving unit 10. A further single ended rail receiving unit (as depicted in FIGS. 3 and 5) is then inserted in the upper portion of the upper baluster 2*b*. This allows two vertical rails to be inserted though the baluster, at the top of the baluster and substantially halfway down.

Alternative and preferred embodiments of an improved rail receiving unit 20, 200 are depicted in FIGS. 8*a-d*, 9*a-d* and 10. In this embodiment there is a dual benefit that the inner housing can both rotate within the inner housing 23 and pivot about the securing pins 22 giving more flexibility in use.

Figure 10:
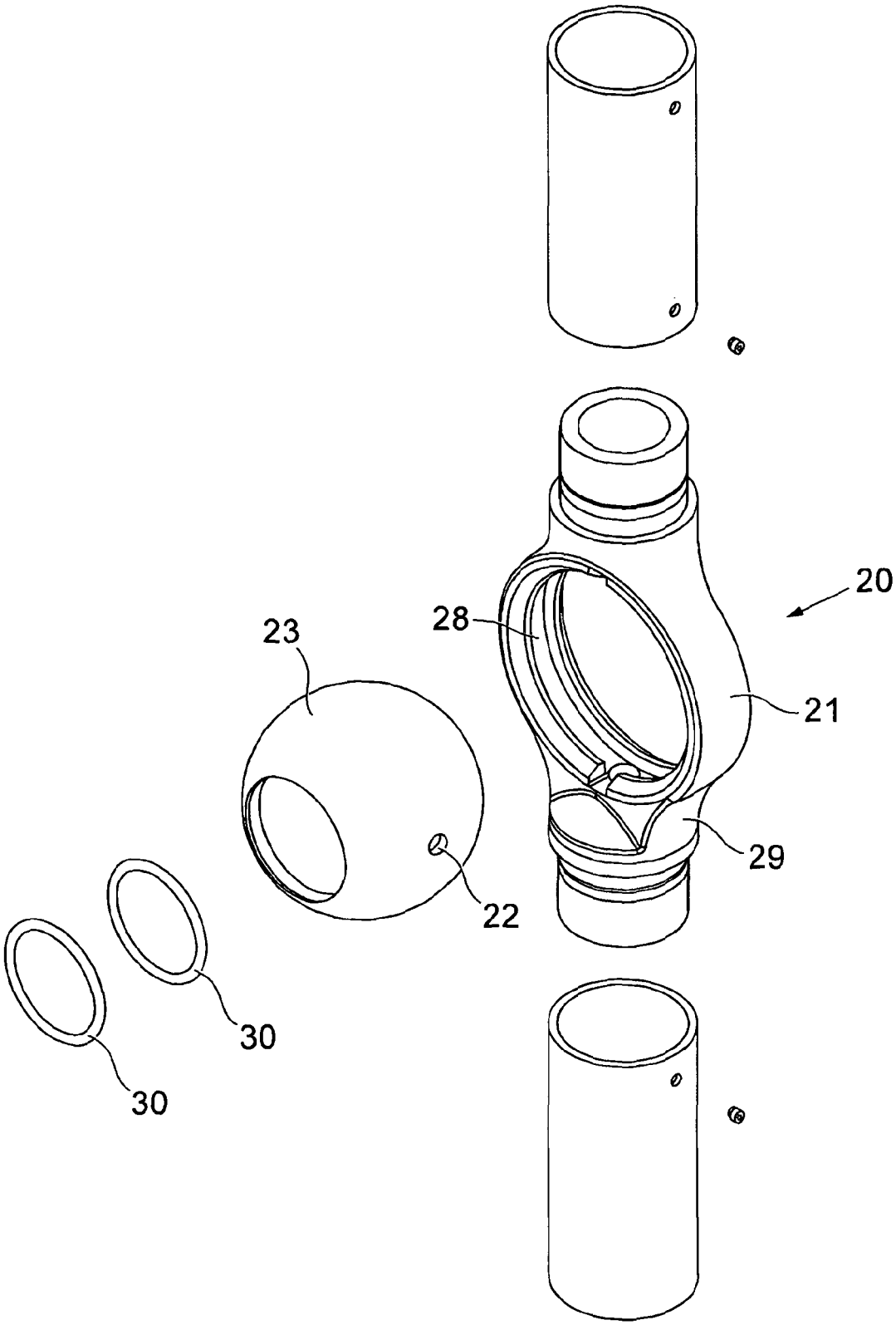
FIG. 10 is an exploded view of the baluster also shown in FIGS. 9*a-d.*

In each case the rail receiving unit 20, 200 has an outer housing 21, 210 which has been cast in a single piece from a material such as carbon steel. In both embodiments that outer housing 21, 210 is in a ring shape with a circular inner circumference (the inner circumference is best seen in FIG. 10). The inner circumference comprises a groove or channel 28, the walls of which are provided with a notch 29, 290 or lowered region.

As with the previous embodiments, the inner housing 23, 230 is provided as a ball or sphere with a aperture channel 24 running through the centre (most clearly shown in FIG. 10). The aperture channel 24 is shaped to receive a rail 3*a* or 3*b* (shown only in FIG. 1) and will generally have a circular cross section slightly larger than a standard handrail horizontal rail 3*a* or 3*b*. The inner housing is of a size that will sit within the central aperture of the outer housing 21,210 and is held in place by pivot pins 22, 220, which in the embodiments shown extend from the outer surface of the inner housing 23, 230. The pivot pins are shaped to fit through the notches 29,290 present on the outer wall of the channel 24 to allow the inner housing to then be held in the channel 24 in such a manner that the inner housing will be able to pivot about the axis formed by the pivot pins, relative to the outer housing. Furthermore, the inner housing 23, 230 can also be rotated in relation to the outer housing 21, 210 as the pivot pins are able to move within (and thus rotate about) the channel 24. The notches 29, 290 act as a keyway to allow the inner housing 23, 230 to be removably held within the outer housing 21, 210.

The inner housing may be held in position simply be friction fit, however, it is possible to provided the channel 24 with a shaped inner surface to facilitate the inner hosing being held at pre-specified points within the channel.

The association of the rail receiving unit 20, 200 will be in the same manner as described for the previous embodiments so will not be repeated here in detail. However, in any of the embodiments, a more secure fit can be obtained between the rail and the rail receiving unit by including a rubber cuff or O-ring 30 in the inner aperture of the inner housing. This is best seen in FIG. 10 where a rubber O-ring 30 is provided at either edge of the inner housing 23, 230, being held within a groove.

Although the preferred embodiments above describe the pivot pins or securing pins extending from and integral with the inner housing, and the channel formed in the inner surface of the outer housing; it could be envisaged that the pivot pins or securing pins could extend from and be integral with the outer housing and the channel be formed circumferentially around the outer surface of inner housing.

The above embodiments are by way of description only and should not be considered as being unduly limiting, but merely as a guide as to how the present invention can be put into practise.

In particular it could be envisaged that the rail receiving unit can be varying shapes and profiles and can be adapted to receive rails of varying cross sections. Furthermore, a skilled or unskilled person could see how a handrail assembly system could be provided where a user is given some or all of the component parts that are required to assemble a handrail.

The invention claimed is:

1. A rail receiving unit for a handrail assembly, the unit comprising:

an annular outer housing, the outer housing comprising:

a substantially circular aperture extending therethrough, the aperture defining a first axis through a center thereof;

a radially recessed groove extending at least partially around a periphery of an inner circumferential surface of the aperture, the groove including a pair of diametrically opposed notches extending axially outward from the groove; and one or more attachment sections each projecting from a respective upper or lower portions of the outer housing, the one or more attachment sections each secured to a portion of a respective tubular baluster; and a spherical inner housing disposed within the aperture of the outer housing, the inner housing comprising:

a sleeve channel extending through a center of the inner housing, the channel receiving a rail; and a pair of diametrically opposed projections extending from an outer surface of the inner housing, the projections defining a second axis extending through both projections, wherein the projections are configured to be inserted through the notches and into the groove of the outer housing;

wherein inner housing is rotatable about the first axis by sliding the projections within the groove, and the inner housing is pivotable about the second axis, such that an angular position of the rail relative to the receiving unit is variable.

2. The rail receiving unit as in claim 1, wherein the sleeve channel is provided with one or more rubber seals.

3. The rail receiving unit as in claim 2, wherein the one or more rubber seals sit within grooves formed in a wall of the sleeve channel in the inner housing.

4. The rail receiving unit as in claim 1, wherein the attachment sections comprise a protruding tubular section surrounded by a rubber sleeve.

5. The rail receiving unit as in claim 4, wherein an outer circumference of the rubber sleeve is selected to securely fit into a baluster section.

6. The rail receiving unit as in claim 1, wherein the outer housing is a single piece.

7. A baluster comprising one or more rail receiving units according to claim 1.

8. A handrail assembly comprising a plurality of rail receiving units according to claim 1, a plurality of baluster sections, and a plurality of rails.

9. The handrail assembly as in claim 8 comprising a plurality of base plates that receive the plurality of baluster sections.

* * * * *